US006926643B1

(12) United States Patent
Gvoich

(10) Patent No.: US 6,926,643 B1
(45) Date of Patent: Aug. 9, 2005

(54) AEROBIC RAMP

(75) Inventor: Ned Gvoich, Beamsville (CA)

(73) Assignee: GT Merchandising & Licensing LLC, New York, NY (US)

( * ) Notice: Subject to any disclaimer, the term of this patent is extended or adjusted under 35 U.S.C. 154(b) by 18 days.

(21) Appl. No.: 10/374,496

(22) Filed: Feb. 26, 2003

Related U.S. Application Data

(63) Continuation-in-part of application No. 10/166,573, filed on Jun. 10, 2002.

(51) Int. Cl.[7] ..... A63B 22/04
(52) U.S. Cl. ..... 482/52; 482/51
(58) Field of Search ..... 482/51, 52, 142, 482/143, 140, 141

(56) References Cited

U.S. PATENT DOCUMENTS

| | | | | |
|---|---|---|---|---|
| 1,752,110 | A | 3/1930 | Remy | |
| 2,021,801 | A | 11/1935 | Meyer | |
| 3,271,075 | A | 9/1966 | Good | |
| D211,801 | S | 7/1968 | Quinton | |
| D219,475 | S | 1/1971 | Windscheffel | |
| D248,697 | S | 8/1978 | Miller | |
| 4,253,661 | A | 3/1981 | Russell | |
| D268,280 | S | 3/1983 | Rodger | |
| 4,429,869 | A | 2/1984 | Eckstein | |
| D277,220 | S | 1/1985 | Herburger | |
| D281,343 | S | 11/1985 | Krive | |
| 4,603,851 | A * | 8/1986 | Russell | 482/79 |
| 4,654,245 | A * | 3/1987 | Balzer et al. | 428/52 |
| 4,678,234 | A | 7/1987 | Wilson | |
| 5,076,579 | A | 12/1991 | Rickey | |
| 5,127,647 | A * | 7/1992 | Wilkinson | 482/52 |
| D330,234 | S | 10/1992 | Saunders et al. | |
| 5,162,028 | A | 11/1992 | Wilkinson | |
| 5,176,596 | A | 1/1993 | Ullman | |
| 5,213,554 | A | 5/1993 | Goldstein et al. | |
| 5,234,396 | A * | 8/1993 | Wilkinson | 482/142 |
| 5,248,286 | A | 9/1993 | Wilkinson et al. | |
| 5,269,735 | A | 12/1993 | Pfitzenmeier | |
| 5,352,168 | A | 10/1994 | Wilkinson | |
| 5,441,466 | A | 8/1995 | Piaget et al. | |
| 5,472,390 | A | 12/1995 | Faye | |
| 5,474,509 | A | 12/1995 | Hodgdon | |
| D367,369 | S | 2/1996 | Lovegrove et al. | |
| 5,512,026 | A | 4/1996 | Wilkinson | |
| 5,533,948 | A | 7/1996 | Wilkinson | |
| 5,536,072 | A | 7/1996 | Chang | |
| 5,540,638 | A | 7/1996 | Wilkinson | |
| 5,540,642 | A | 7/1996 | Sprague | |
| 5,549,536 | A | 8/1996 | Clark | |

(Continued)

FOREIGN PATENT DOCUMENTS

| | | | |
|---|---|---|---|
| GB | 2 367 793 | A | 4/2002 |

*Primary Examiner*—Justine R. Yu
*Assistant Examiner*—Tam Nguyen
(74) *Attorney, Agent, or Firm*—Schweitzer Cornman Gross & Bondell LLP

(57) ABSTRACT

A step exercising system for an aerobic step workout is constructed as a portable inclined step ramp. The ramp is sloped towards a user such that the user can step up onto the ramp at various heights, thereby regulating the degree of intensity of the workout without having to suspend the workout to adjust the step height, as is the case when using a conventional aerobic step having a raised level platform.

11 Claims, 16 Drawing Sheets

U.S. PATENT DOCUMENTS 5,558,603 A 9/1996 Simon
5,584,779 A 12/1996 Knecht et al.
5,591,105 A * 1/1997 Dalebout et al. ..... 482/52
5,620,404 A 4/1997 Eyman
5,645,511 A 7/1997 Le Roux et al.
5,651,753 A 7/1997 Wilkinson
5,656,000 A * 8/1997 Russell ..... 482/52
5,672,144 A 9/1997 Hulme
5,683,331 A 11/1997 Dalebout
5,749,555 A 5/1998 Albrecht
5,833,136 A * 11/1998 Japp ..... 238/14
5,842,955 A 12/1998 Wilkinson
5,879,272 A * 3/1999 Mekjian ..... 482/51
6,024,680 A 2/2000 Thompson, II
6,132,338 A * 10/2000 Shifferaw ..... 482/30
6,158,552 A 12/2000 Gould et al.
6,206,805 B1 3/2001 Helton et al.
6,290,628 B1 9/2001 Wilkinson
D451,292 S 12/2001 Cheris et al.
6,454,357 B1 9/2002 Foulger
6,589,631 B1 * 7/2003 Suzuki et al. ..... 428/172

* cited by examiner

FIG. 18
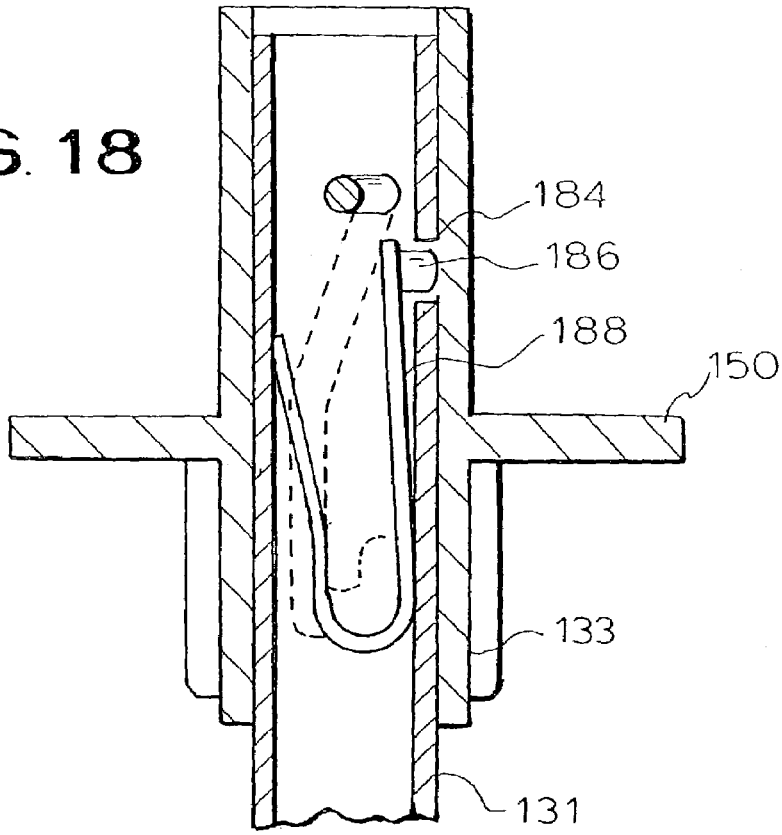
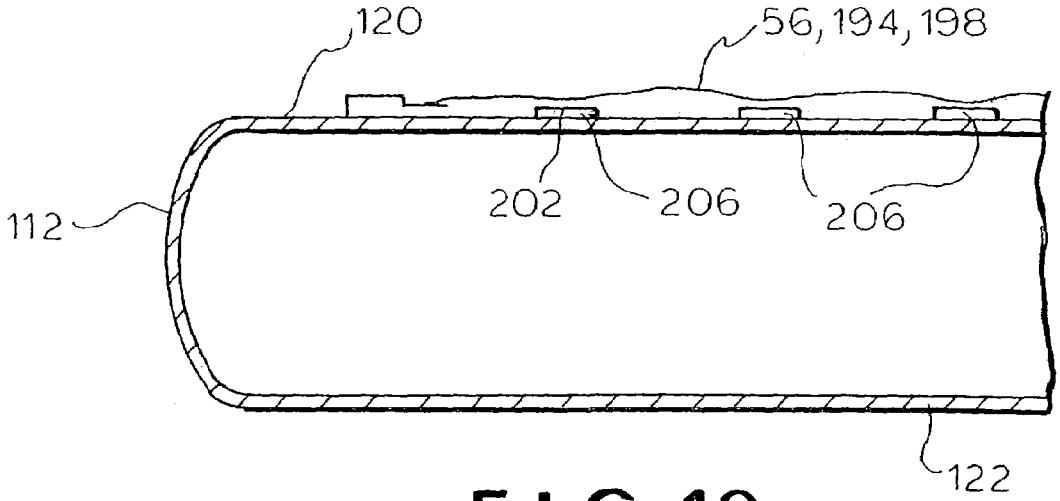
FIG. 19

AEROBIC RAMP

RELATED APPLICATIONS

This application is a Continuation-In-Part of U.S. patent application Ser. No. 10/166,573, filed Jun. 10, 2002.

BACKGROUND OF THE INVENTION

1. Field of the Invention

This invention relates to step systems for aerobic and cardio-vascular activities.

2. Description of the Prior Art

By way of background, a popular form of cardio-vascular training is aerobic stepping. An aerobic step workout is performed by stepping on and off a raised, level step platform. The steps are choreographed, usually performed to music, and leader-driven by an instructor in a class setting or on videotape for home exercise. Workout intensity is largely dependent on the step platform height. Presently, step platforms require a user to suspend the workout while an adjustment to height is made. This is disruptive. Additionally, a user who is becoming fatigued and who should probably lower the step height will not do so, and instead will continue the workout, allowing for the possibility of over fatigue and potential miss-step. Another drawback of existing level step platforms is the great amount of load placed on the knee joint while performing the step up to the level platform. To step up on a level platform, the leg is moved forward by hip flexion. At the same time, the foot is brought up to a position above the level platform by knee flexion. Once the foot is on the platform it has a surface from which to push off. The hip and knee joints go into extension to move the body up against gravity. This places the knee joint under a substantial compression load. Further, most aerobic or cardiovascular activity such as stepping will cause the participants to perspire. This perspiration has a tendency to pool on the level step platform, creating the potential for injury by slipping on the surface.

SUMMARY OF THE INVENTION

The foregoing problems are solved and an advance in the art is obtained by a novel step exercising system for an aerobic step workout comprising a portable inclined step ramp. The ramp is sloped towards a user such that the user can step onto the ramp at various height levels, thereby easily regulating the degree of intensity of the workout. There is no need to suspend the workout to perform a height adjustment, as is the case when using a level aerobic step platform. There is also reduced stress on the knee joint.

In exemplary embodiments of the invention, the ramp is configured to define a front portion, a back portion, an upper workout surface portion, and an underside portion. The incline of the ramp can be provided in various ways, with adjustable legs or other incline members being preferred so that the incline of the ramp can be altered. The legs can be permanently or removably attached to the underside portion of the ramp proximate to the back portion thereof. In addition, adjustable legs can also be mounted to the front portion of the ramp so as to allow the overall height of the ramp to be varied. The ramp can also have one or more additional features, such as a radiussed leading edge on the ramp's front portion for contacting an independent support surface. Further, the ramp can be formed with grooves that channel perspiration from the upper work surface portion of the ramp and serve to visually divide the ramp into multiple workout areas, such as a central workout area and two lateral workout areas. Each workout area can be color-coded so as to allow a user to follow a choreographed routine. The front of the center workout area may be recessed relative to the lateral workout areas so as to facilitate easier access to all workout areas by the user. The upper workout surface portion is preferably configured with a non-slip surface.

BRIEF DESCRIPTION OF THE DRAWINGS

The foregoing and other features and advantages of the invention will be apparent from the following more particular description of preferred embodiments of the invention, as illustrated in the accompanying Drawings, in which:

FIG. 18 is a cross-sectional view of the adjustable leg, showing the spring resistance means; and FIG. 19 is a cross sectional view, taken along line 19—19 of FIG. 9.

DETAILED DESCRIPTION OF THE PREFERRED EMBODIMENT

Figure 1:
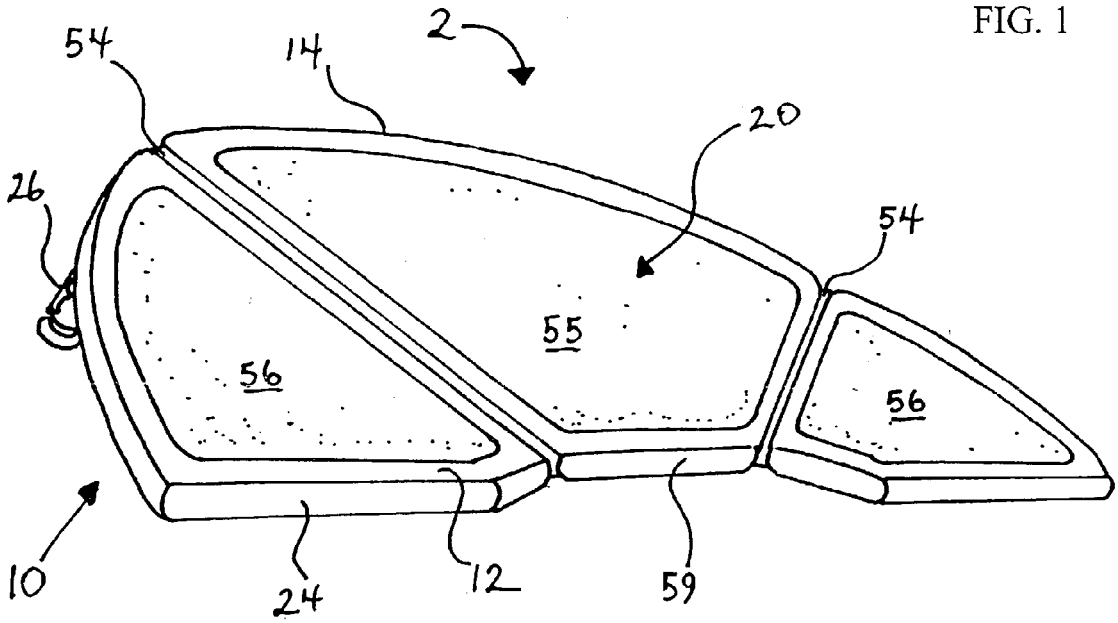
FIG. 1 is a front perspective view showing a first embodiment of a step exercising system constructed in accordance with the invention.

A step exercising system for an aerobic workout will now be described by way of exemplary embodiments shown by the drawing figures, in which like reference numerals indicate like elements in all of the several views.

Figure 2:
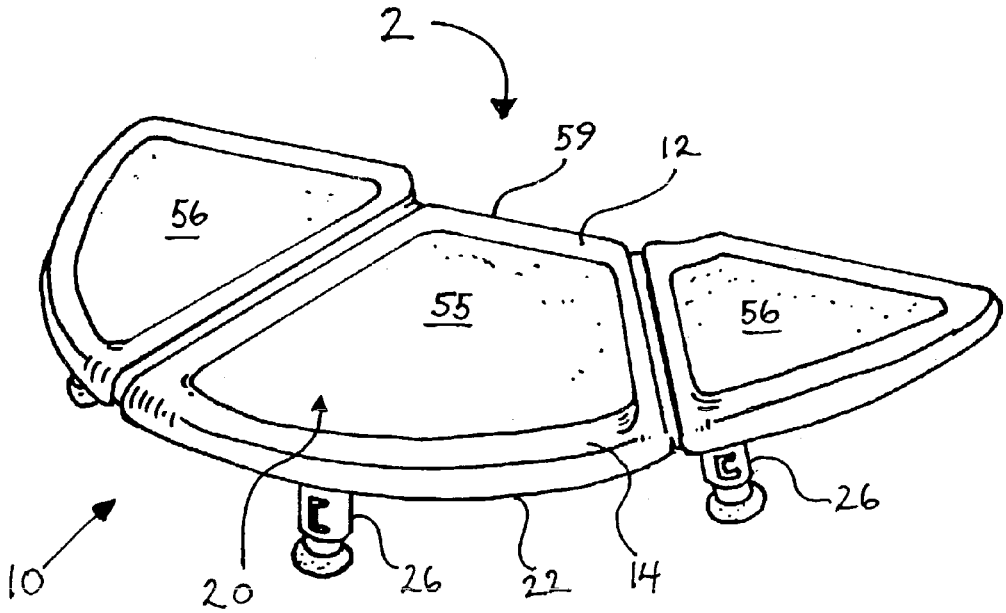
FIG. 2 is a rear perspective view of the step exercising system of FIG. 1.
Figure 3:
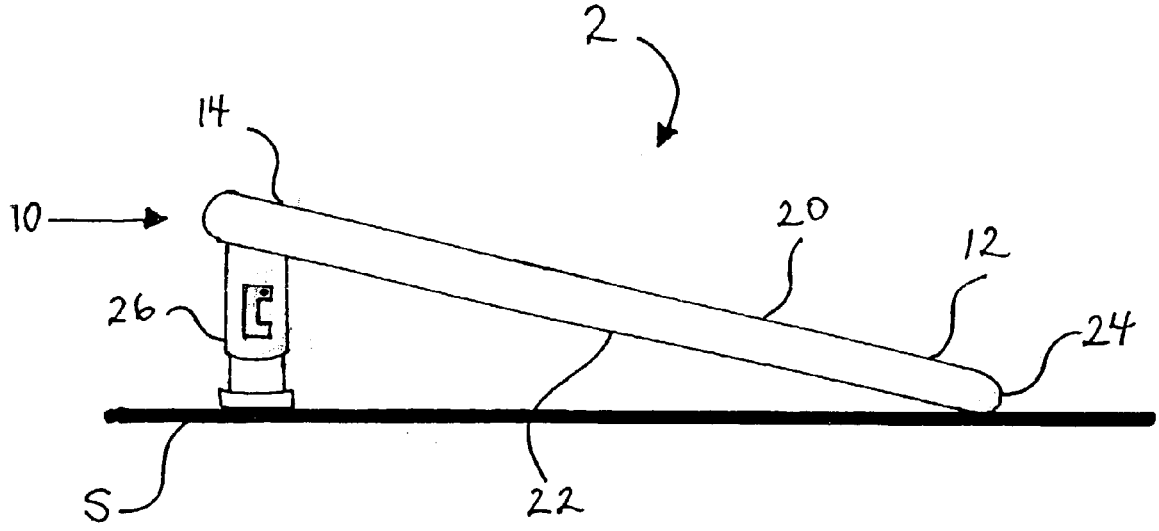
FIG. 3 is a side elevation view of the step exercising system of FIG. 1.

Turning to FIGS. 1–3, a step exercising system 2 in accordance with a first exemplary embodiment of the invention is shown at rest on a support surface S (see FIG. 3), such as a floor. The step exercising system 2 includes a portable inclined aerobic step ramp 10, whose overall configuration is best shown in FIGS. 1 and 2. It will be appreciated that the ramp 10 can be made of any suitable material capable of supporting a person stepping thereon. Examples include but are not limited to plastics such as ABS (acetyl butyl styrene), polyethylene or the like. The ramp 10 can be formed with such materials using a blow mold technique, pressure forming, or injection molding. As an alternative to plastic, other material such as metal (e.g. aluminum) could be used to form the ramp 10.

Although shown as being semi-circular in shape, the ramp 10 may be constructed in various configurations, depending on design preferences. Such shape variations notwithstanding, the ramp will generally define a front portion 12 adapted to face a user and a back portion 14 that lies away from the user. The ramp 10 will further define an upper workout surface portion 20 and an underside portion 22. As can be seen in FIG. 3, the back portion 14 is positioned at a height which is above the front portion 12 relative to the support surface S, such that the upper workout surface portion 20 is inclined toward the person at a constant angle during use. Moreover, the leading edge 24 of the front portion 12 preferably rests on the support surface S, so as to facilitate easy stepping onto the ramp 10. The ramp 10 will preferably be constructed such that the incline of the upper workout surface portion 20 has about a 10–30 degree angle relative to the support surface S. An angle of incline less than about 10 degrees will be too small to facilitate an adequate workout, and an angle greater than about 30 degrees will be too large to enable the user to step securely up onto the ramp 10 and will tend to hyper extend the achilles tendon. It will be appreciated that the inclined configuration of the ramp can be provided in various ways. In FIGS. 1–3, the incline is provided by mounting incline members in the form of adjustable legs 26 to the underside portion 22, proximate to the back portion 14. Other types of incline members could also be used, such as non-adjustable legs, frames, blocks, or otherwise. Another alternative would be to form the ramp 10 as a wedge-shaped structure in which the back portion 14 is thicker than the front portion 12.

The legs 26 in the ramp embodiment of FIGS. 1–3 can be made of any suitable material capable of supporting a person, including plastics as described above, and metals. The legs 26 can be attached to the underside portion 22 in any suitable fashion. For example, if the ramp 10 is molded, the legs 26, or a portion thereof, could be integrally formed with the ramp 10 during the molding process so as to be built-in to the ramp 10. Other alternatives include attachment by welding, bolting, threading or the like, depending on whether the legs are to be permanently or removably attached to the ramp 10.

Figure 4:
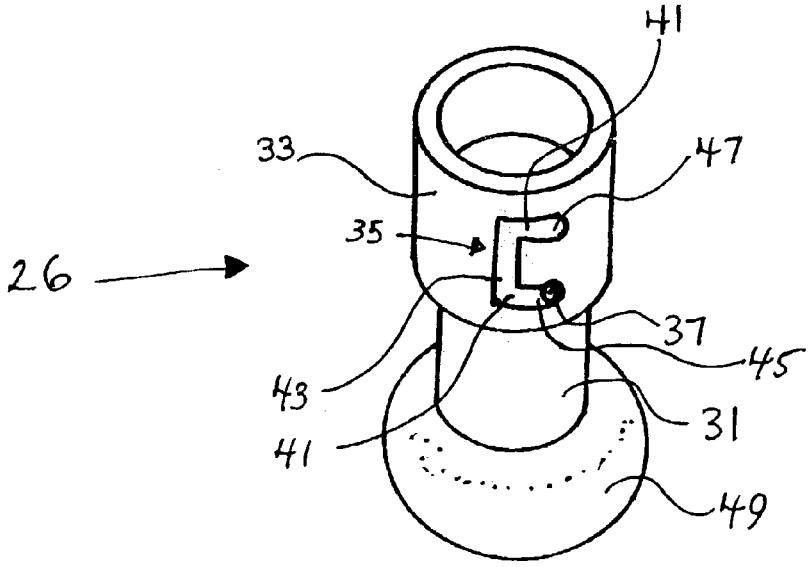
FIG. 4 is a detailed perspective view of an exemplary height adjustable incline member for the step exercising system of FIG. 1.

The legs 26 are constructed with a height adjustable feature so that the incline angle of the ramp 10 can be altered. FIG. 4 illustrates one example of a leg 26 having height adjustment capability. As shown in FIG. 4, the leg 26 comprises an inner tubular member 31 that is slidably disposed within, and surrounded by, an independent outer tubular member 33 that is attached to the ramp 10. The inner tubular member 31 is thus capable of telescoping from the outer structure 33, allowing for a change in length of the leg 26. The inner tubular member 31 may be secured in position relative to the outer tubular member 33 in various ways.

In FIG. 4, the outer tubular member 33 is constructed with a slotted opening 35 and the inner tubular member 31 is constructed with a protruding pin member 37 that is received in the slotted opening 35. The slotted opening 35 includes two horizontal channels 41 connected by a vertical channel 43. To adjust the length of the leg 26 (thereby adjusting the height and incline of the ramp 10), the inner tubular member 31 is rotated so that the pin member 37 can be slid from a fixed point 45 in one of the horizontal channels 41, then through the vertical channel 43 of the slotted opening 35, and to another fixed position 47 in the other horizontal channel 41. Note that additional horizontal channels 41 can be provided depending on the number of height adjustments desired. Other adjustment arrangements could also be used, including pins inserted through holes in the inner tubular member 31 and outer tubular member 33.

The legs 26 can further be mounted with a slip-resistant tip 49 at the end, which rests on the support surface S. The tip 49 may be made of any suitable slip-resistant material, including but not limited to silicone rubber, high friction plastic, or otherwise. As best shown in FIG. 4, the front portion 12 of the ramp 10 may be constructed with a radius on the leading edge 24. The radius enables the leading edge 24 to contact the support surface S without damaging it, as might be the case from a squared edge. The radius also facilitates ramp angle changes by allowing the leading edge 24 to contact the support surface at various locations. In addition, the radius provides a friendlier contact surface with a user.

Figure 5:
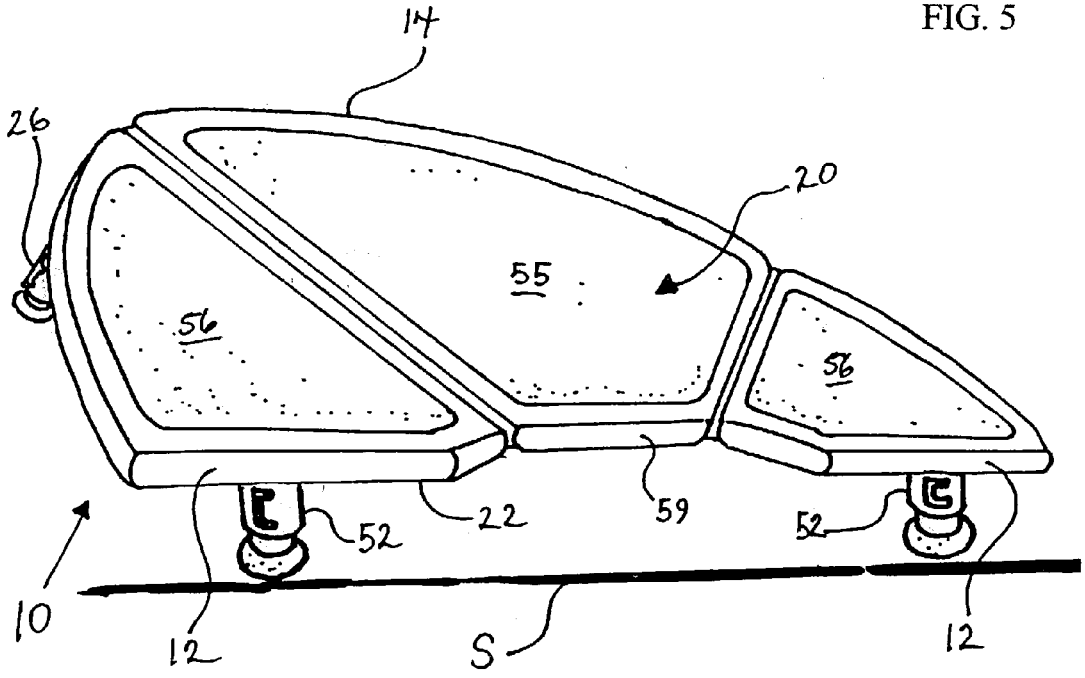
FIG. 5 is a front perspective view showing a second embodiment of the step exercising system constructed in accordance with the invention.
Figure 6:
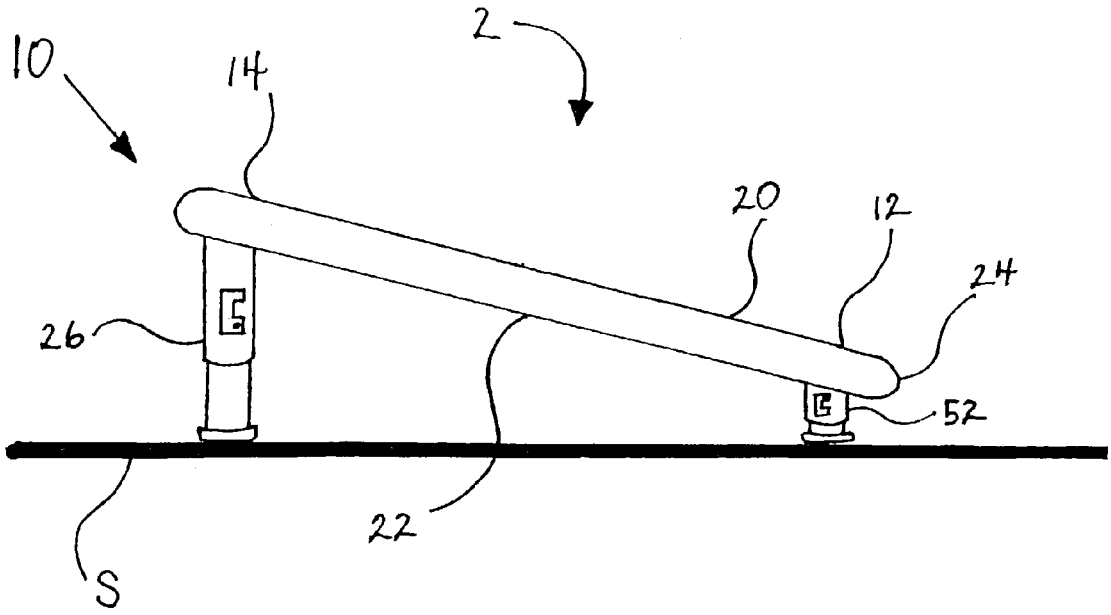
FIG. 6 is a side elevation view showing the step exercising system of FIG. 5.

Turning now to FIGS. 5 and 6, a second embodiment of the ramp 10 is shown wherein the underside 22 mounts adjustable legs 52 proximate to the front portion 12 of the ramp 10. The adjustable legs 52 directly contact the support surface S and enable the leading edge 24 to be positioned above the support surface rather than resting directly thereon. This allows a user to intensify the workout by having a higher initial starting point for the workout.

Figure 7:
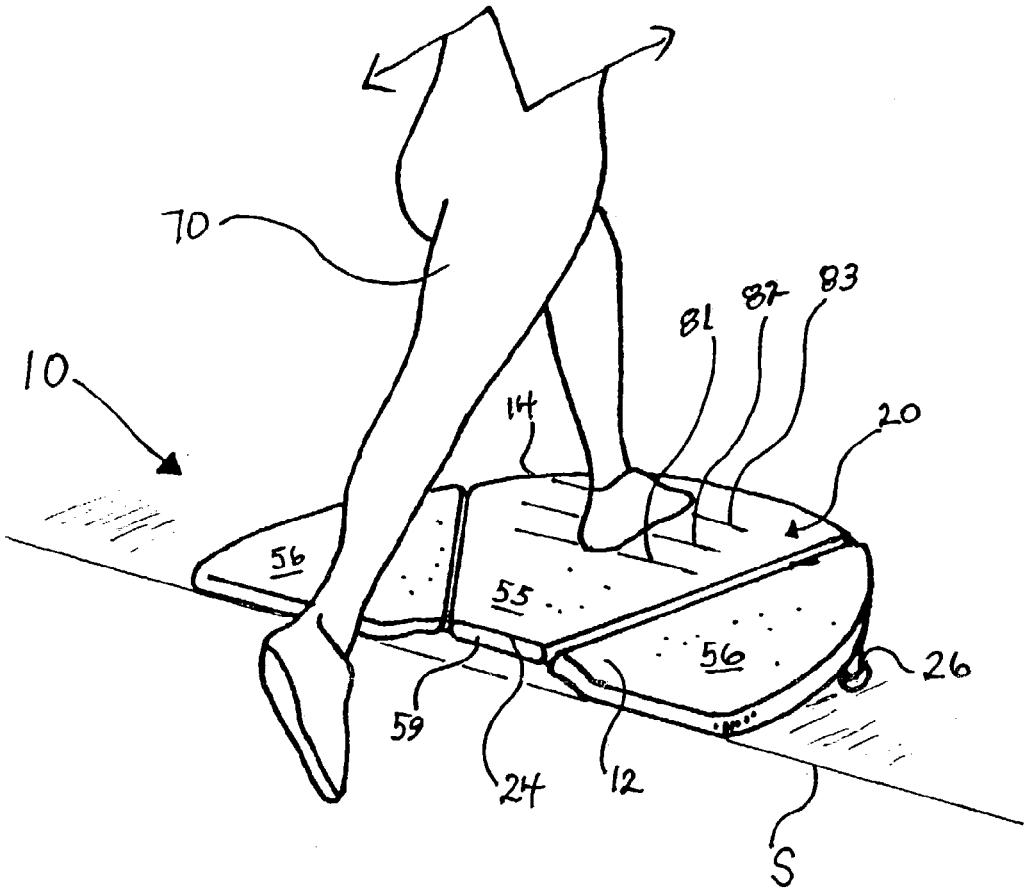
FIG. 7 is a front perspective view of the step exercising system of FIG. 1 in use.
Figure 8:
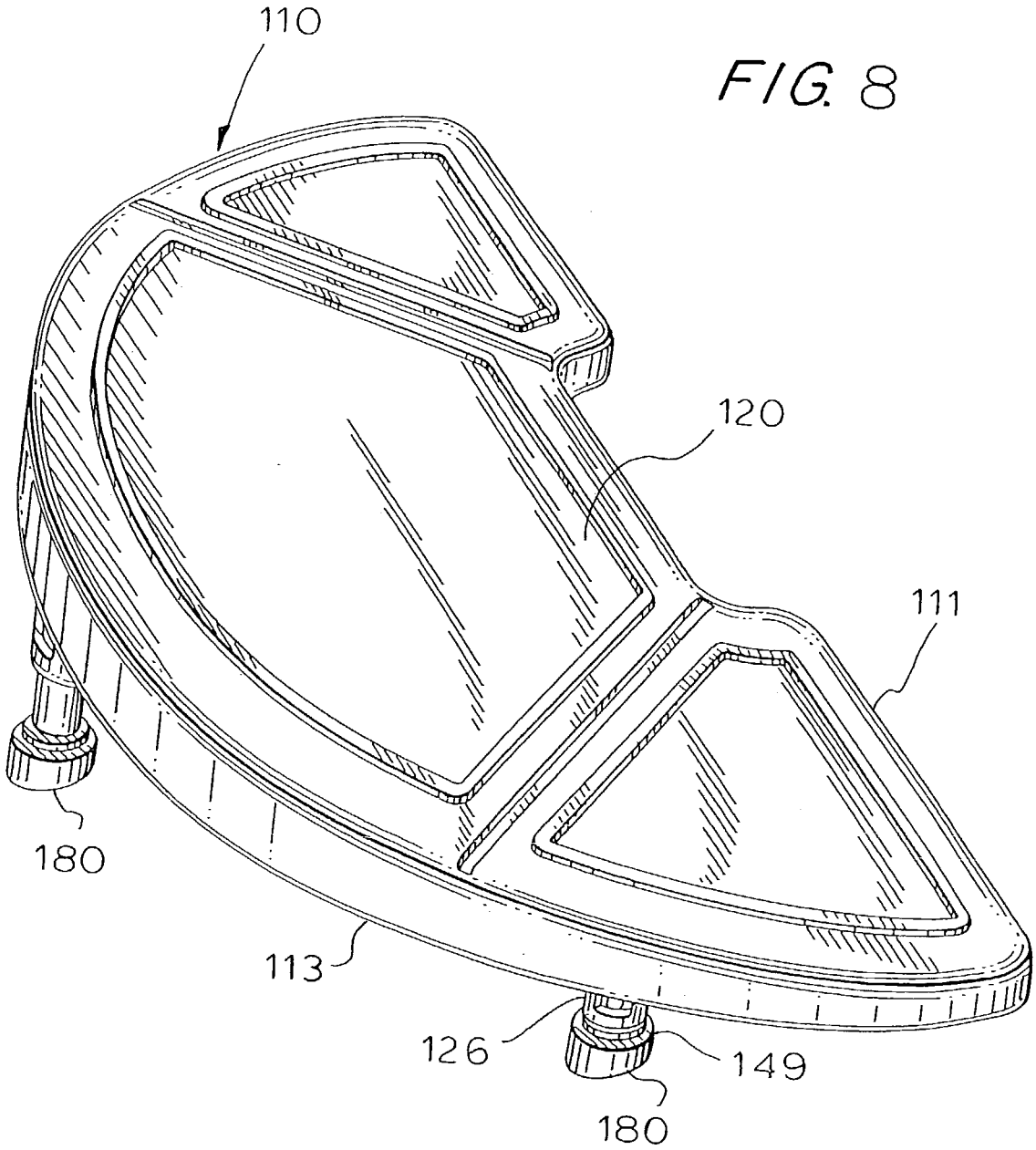
FIG. 8 is a front perspective view showing a third embodiment of the step exercise system constructed in accordance with the invention.
Figure 9:
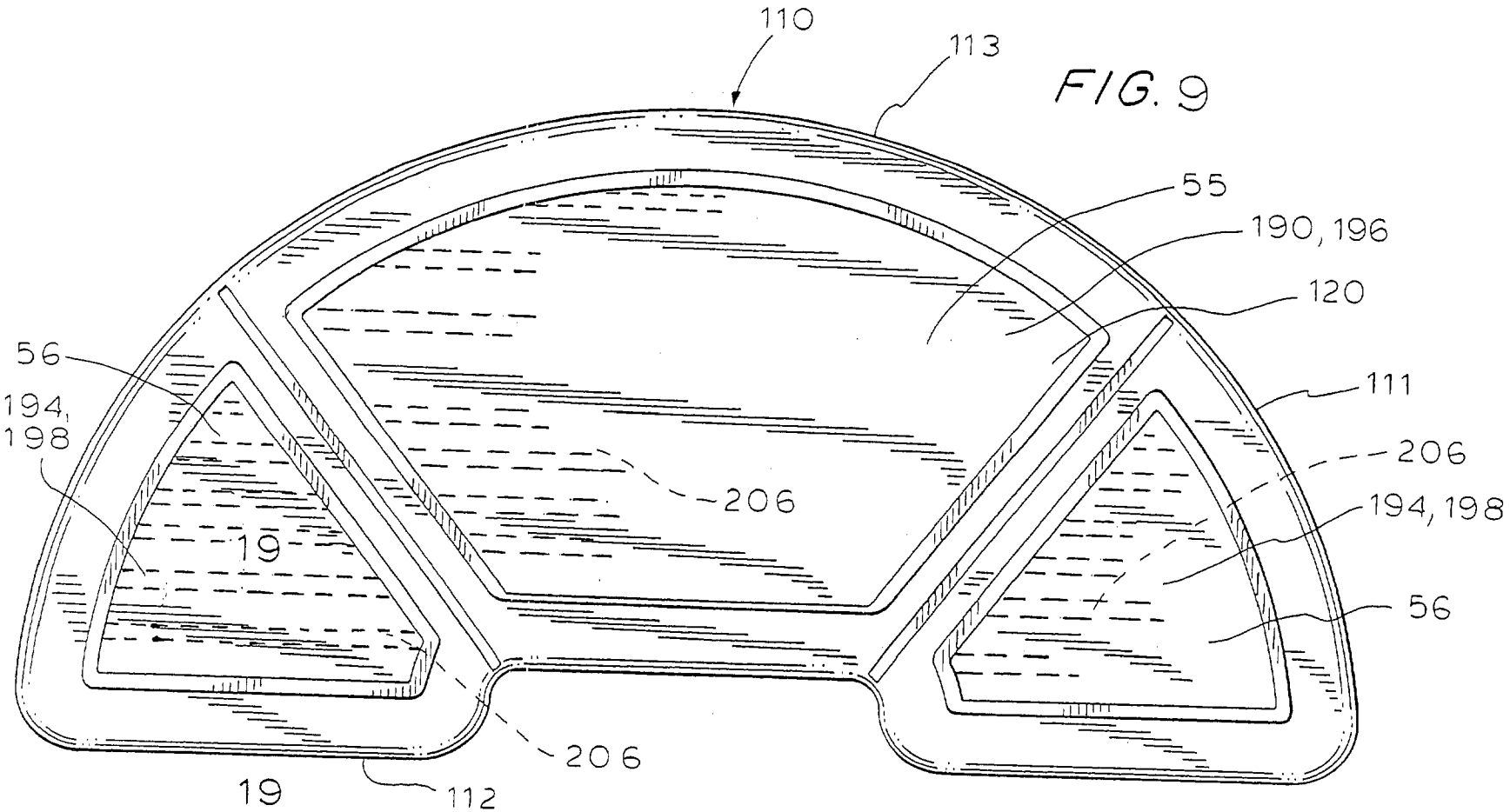
FIG. 9 is a top plan view of the step exercise system of FIG. 8.

As can be seen in any of FIGS. 1–2 and 5, and as further illustrated in FIG. 7, the upper workout surface portion 20 of the ramp 10 comprises grooves 54 that divide the surface into visually distinct workout areas. The grooves 54 can be formed in a variety of ways. If the ramp 10 is formed as a single unit, the grooves 54 can be formed therein during the fabrication process or thereafter in subsequent processing. Alternatively, the grooves 54 could be defined by fabricating the ramp 10 as separate sections that are suitably fastened together such that a space is formed between adjacent sections to define the grooves 54.

In the embodiments of FIGS. 1–3 and 5, the grooves 54 divide the upper workout surface portion 20 into three visually distinct workout areas, namely, a center workout area 55 and two distinct side workout areas 56 adjacent to the center workout area 55. Other configurations in which the number and arrangement of workout areas is different could also be used. To further visually differentiate the workout areas 55 and 56, and to enable a user to follow a step workout choreographed to different workout areas, the workout areas 55 and 56 can be color-coded.

The workout areas 55 and 56 are also preferably constructed with a non-slip surface configuration. The non-slip configuration could be provided by suitably texturing the upper workout surface portion 20 in its initial construction. Alternatively, the non-slip configuration can be provided by a separate material that is directly applied to the workout areas 55 and 56 after initial construction, as by spraying, brushing, or adhering. Examples include, but are not limited to, textured paints, rubber coatings, or various inserts or stickers made of rubber, sand paper, or other materials. Note that the center workout area 55 is constructed with a recess 59 at the front portion 12 of the ramp 10. The recess 59 is adapted to enable a user easier access to the two side workout areas 56 such that the user may contact a side workout area 56 without stepping over the center workout area 55, as will now be described.

FIG. 7 shows the ramp 10 as it would be used during a typical workout. It is assumed that the ramp 10 includes plural workout areas as described above. First, a user 70 can predetermine the overall incline of the ramp 10 by adjusting the length of the legs 26 (when included in the ramp's construction). Next, the ramp is placed on the support surface S with the leading edge 24 in direct contact with the support surface S (or above the support surface S if the ramp 10 is so constructed and the user desires such a setup). The ramp 10 remains in this constant position throughout the workout. The user 70 stands facing the ramp 10 proximate to the leading edge 24 of the front portion 12. The user 70 steps on and off the various workout areas 58 of the upper work surface portion 20 of the ramp 10 as dictated by a choreographed workout. Throughout the workout, the user 70 can vary the height of each step by choosing a point (e.g. 81, 82, or 83) of contact on the ramp 10 and thereby modifying the intensity of the workout.

Referring to FIGS. 8–19, a third embodiment of the portable inclined aerobic step ramp 110 of the present invention includes a plurality of adjustable legs 126 affixed to an underside portion 122 and are preferably disposed adjacent to a peripheral edge 113 of the underside portion 122.

The underside portion 122 is preferably substantially parallel to an upper workout surface portion 120 of a main body 111 of the portable inclined aerobic step ramp 110; and is spaced a distance from the upper workout surface portion 120. The portable aerobic step ramp 110 may be formed in a hollow configuration such that a gap 115 exists between an interior surface 117 of the upper workout surface portion 20 and an interior surface 119 of the underside portion 122 (see FIGS. 15 and 16).

The adjustable legs 126 preferably include a fixed, outer tubular member 133 and an inner tubular member 131 which is telescopically, slideably received within the outer tubular member 133. An attachment flange 150 is integrally formed with or otherwise affixed to the outer tubular member 133. The attachment flange 150 extends radially outwardly from the outer tubular member 133 and is preferably permanently affixed to the underside portion 122 of the main body 111 by bolts, or other suitable attachment means.

Preferably, the attachment flange 150 is affixed to the outer tubular member 133 intermediate upper and lower ends 152, 154 of the outer tubular member 133 such that the upper end 152 of the outer tubular member 133 extends into the gap 115 between the interior surfaces 117, 119 of the upper workout surface portion 120 and the underside portion 122. Also, the upper end 152 of the outer tubular member 133 abuts or is disposed in close proximity to the interior surface 117 of the upper workout surface portion 120, such that, during periods of high loads, the adjustable legs 126 can provide support directly to the upper workout surface portion 120.

Protruding pin members 137 extends radially outwardly from the inner tubular member 131, substantially perpendicular to a longitudinal axis of the inner tubular member 131, preferably on two opposed sides of the inner tubular member 131. The protruding pin members 137 may be formed from a threaded sleeve and two threaded bolts.

The outer tubular member 133 includes slotted openings 135 into which the protruding pin members 137 extend. The slotted openings 135 are located on opposite sides of the outer tubular member 133 and are preferably separated by 180 degrees. Preferably, one of the slotted openings 135 is aligned to be easily visible by a user.

Each slotted opening 135 includes an upper angled portion 156, a middle longitudinal portion 158 and a U-shaped lower portion 160. The U-shaped lower portion 160 includes a first longitudinal section 162 (which is connected to the middle portion 158), a center, circumferential section 164, and a second longitudinal section 166. The second longitudinal section 166 has a closed end 168, which is aligned with a closed end 170 of the upper angled portion 156 of the slotted opening 135.

The middle longitudinal portion 158, and the first and second longitudinal sections 162, 166 of the U-shaped lower portion 160 are preferably aligned substantially parallel to a longitudinal axis of the inner tubular member 131. The outer circumferential section 164 of the U-shaped lower portion 160 is preferably aligned substantially perpendicular to the longitudinal axis of the inner tubular member 131 (i.e., parallel to the circumference thereof).

The upper angled portion 156 of each of the slotted openings 135 includes a closed end 172 which is aligned with the closed end 168 of the second longitudinal section 166 on a line which is substantially parallel to the longitudinal axis of the inner tubular member. The upper angled portion 156 is preferably disposed within the main body 111.

The upper angled portion 156 extends downwardly from a closed end 172 to the middle longitudinal portion 158 at an angle that is oblique to the longitudinal axis of the inner tubular member 131, preferably at an angle of about 45 degrees from the longitudinal axis of the inner tubular member 131.

Figure 15:
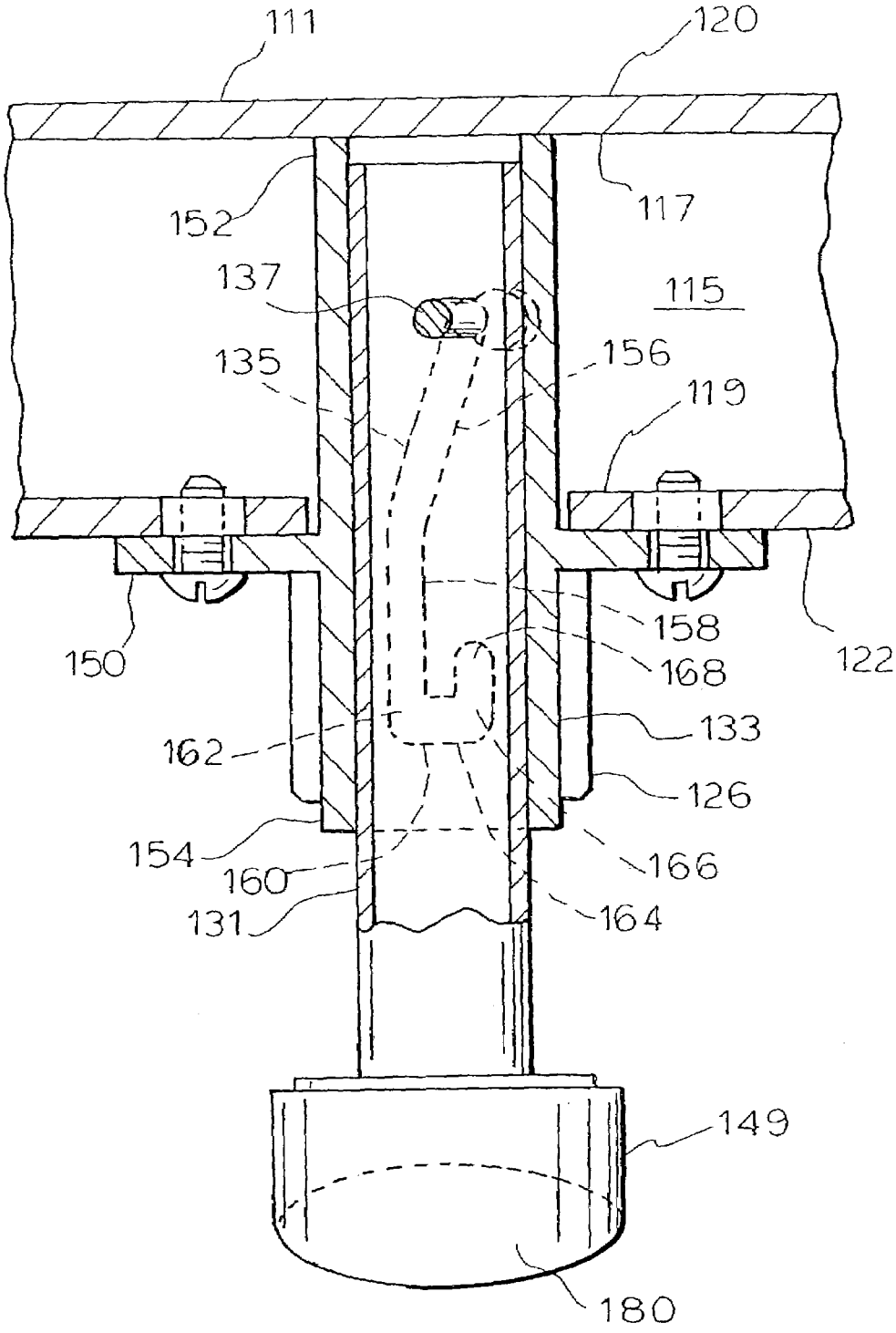
FIG. 15 is a cross-sectional view of the adjustable leg, taken along line 15—15 of FIG. 14, showing the leg in a retracted position.
Figure 16:
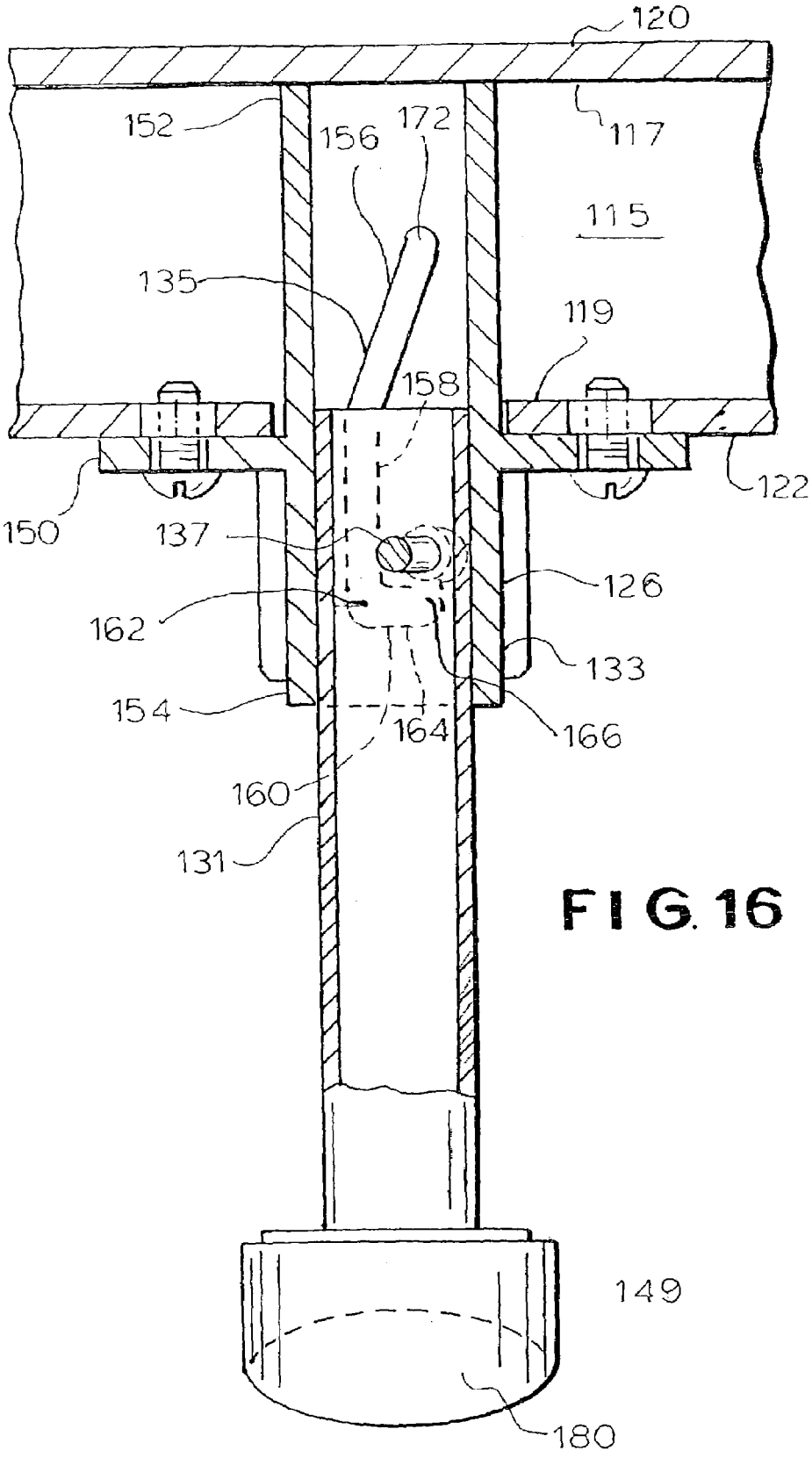
FIG. 16 is a cross-sectional view of the adjustable leg, taken along line 16—16 of FIG. 14, showing the leg in an extended position.
Figure 17:
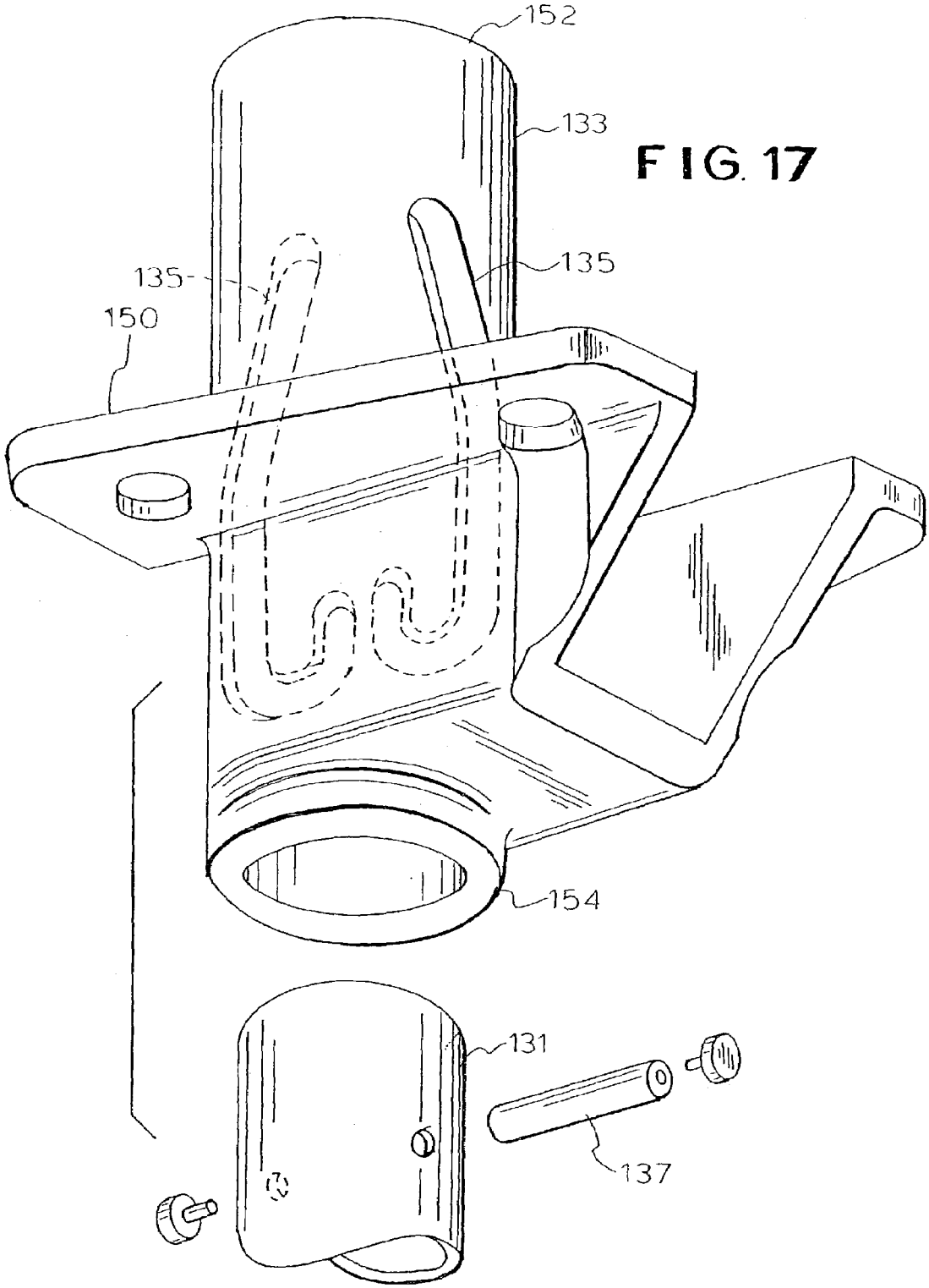
FIG. 17 is an exploded, perspective view of the adjustable leg of the step exercise system of FIG. 8.

As depicted in FIG. 15, each adjustable leg 126 has a retracted supporting position in which the protruding pin member 135 is disposed adjacent the closed end 172 of the upper angled portion 156 of the slotted opening 135. As depicted in FIG. 16, each adjustable leg 126 has an extended supporting position in which the protruding pin member 135 is disposed adjacent the closed end 168 of the second longitudinal section 166 of the U-shaped lower portion 160 of the slotted opening 135. It can be appreciated that when the adjustable leg 126 is in either of the retracted and extended positions, the upward movement of the adjustable leg 126 is prevented.

To articulate the adjustable leg 126 from the extended to the retracted position, the inner tubular member 131 is further extended to a point where the protruding pin member 137 is disposed in a bottom of the second longitudinal section 166. Then, the inner tubular member 131 is rotated relative to the outer tubular member 133 such that the protruding pin member 137 is disposed in a bottom of the first longitudinal section 162. Then, the inner tubular member 131 is urged to retract it further into the outer tubular member 133 until the protruding pin member 137 reaches a bottom of the upper angled portion 156.

Further retraction of the inner tubular member 131 into the outer tubular member 133 causes the inner tubular member 131 to rotate as the protruding pin member 137 passes along and is guided by the upper angled portion 156 until the adjustable leg 126 is in the retracted position. It can be appreciated that when the inner tubular member 131 is in the retracted position, it is in the same rotational orientation relative to the outer tubular member 133 as when in the extended position.

Thus, the upper angled portion 156 serves to automatically properly align the inner tubular portion 131 when in the retracted position. This facilitates the movement of the leg into the extended position, which is desirable since the inner tubular member 131 is disposed within the main body 111 and is not visible to the user. As described in further detail below, this rotational alignment serves to properly align the slip resistant tip 149 attached to the inner tubular member 131.

Figure 10:
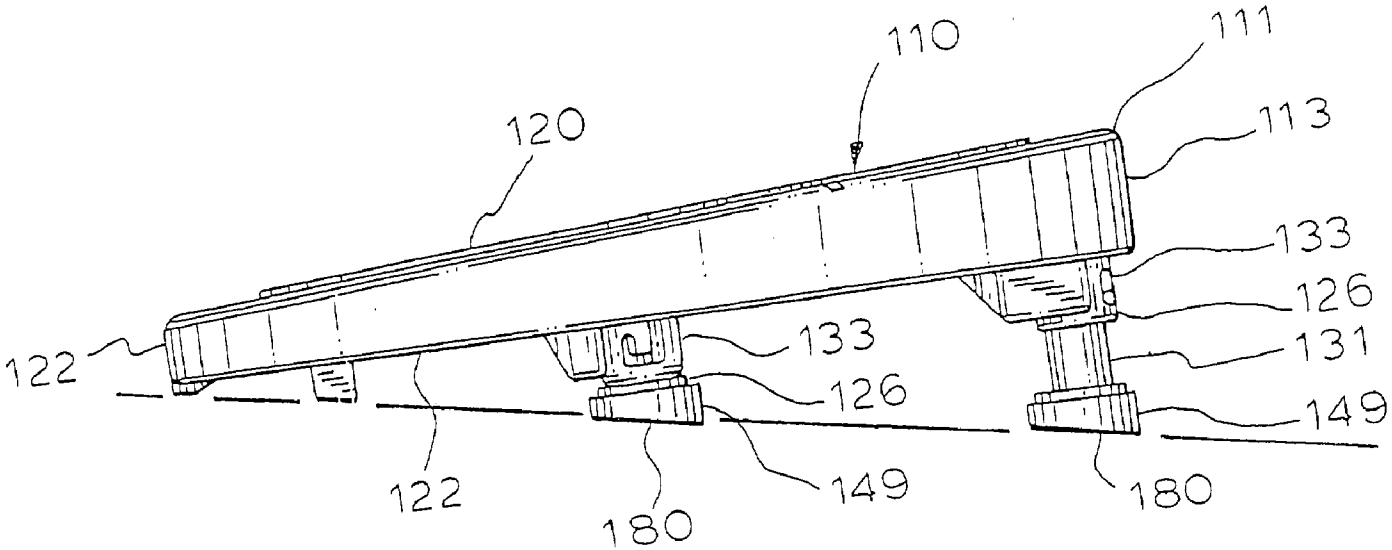
FIG. 10 is a side elevation view of the step exercise system of FIG. 8.
Figure 11:
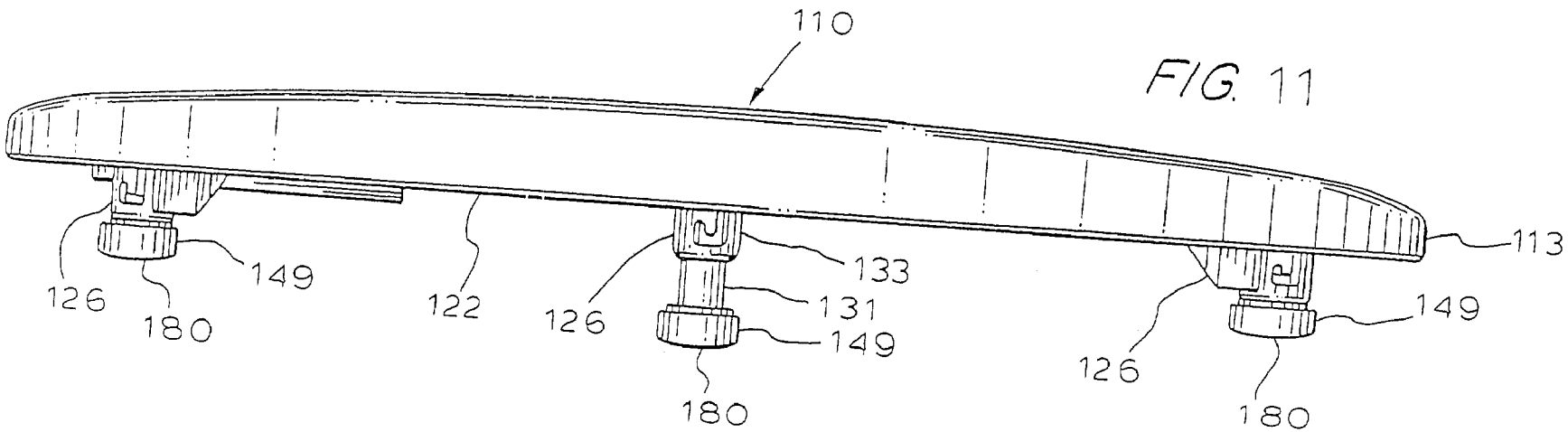
FIG. 11 is a rear elevation view of the step exercise system of FIG. 8.
Figure 12:
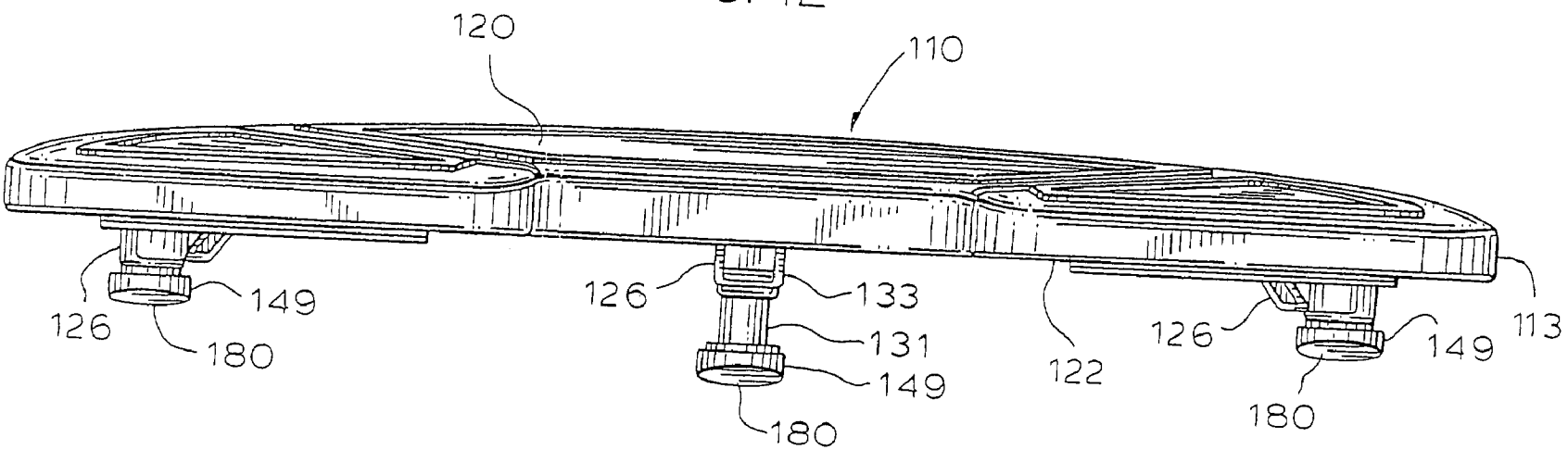
FIG. 12 is a front elevation view of the step exercise system of FIG. 8.
Figure 13:
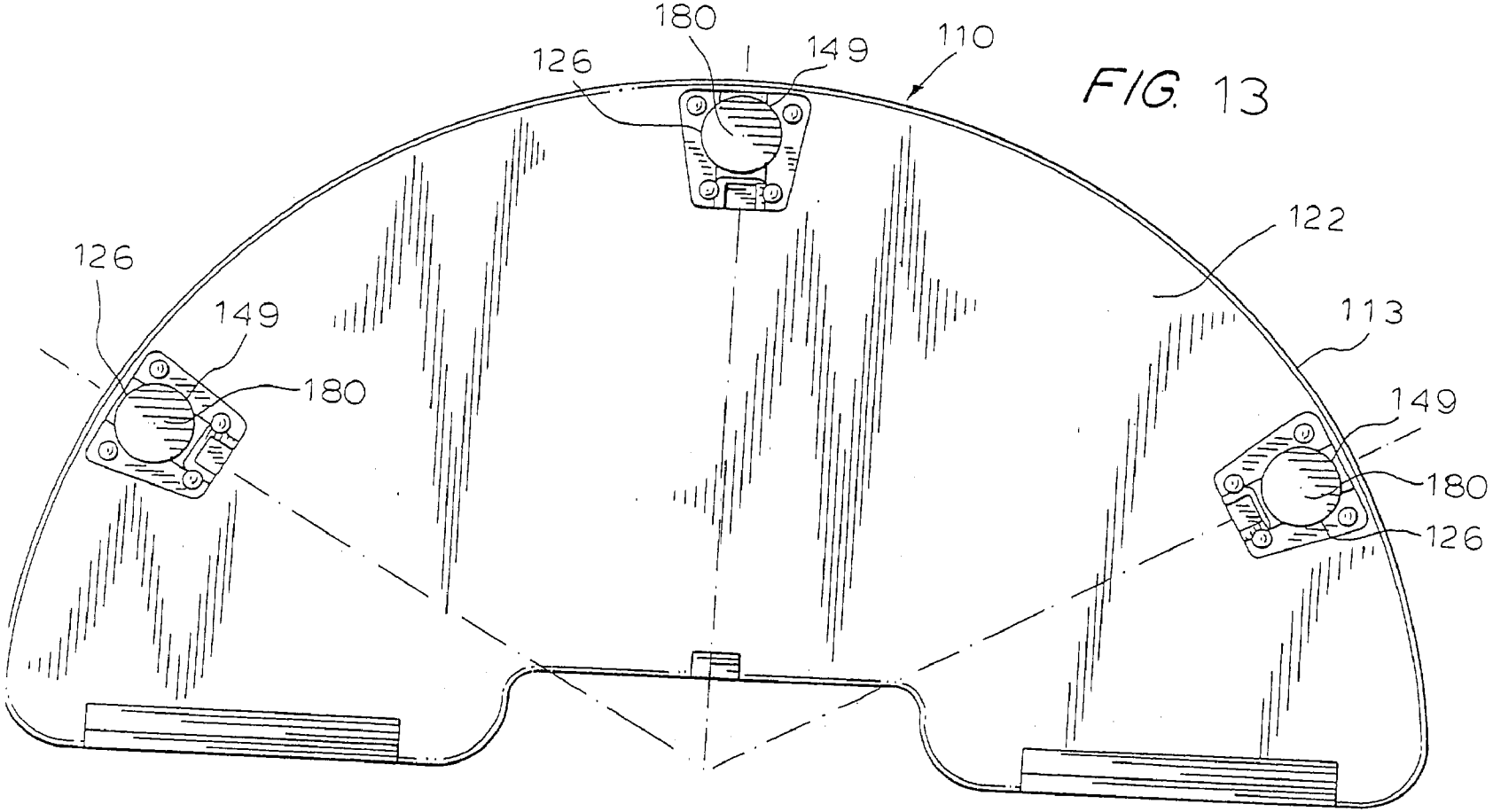
FIG. 13 is a bottom plan view of the step exercise system of FIG. 8.
Figure 14:
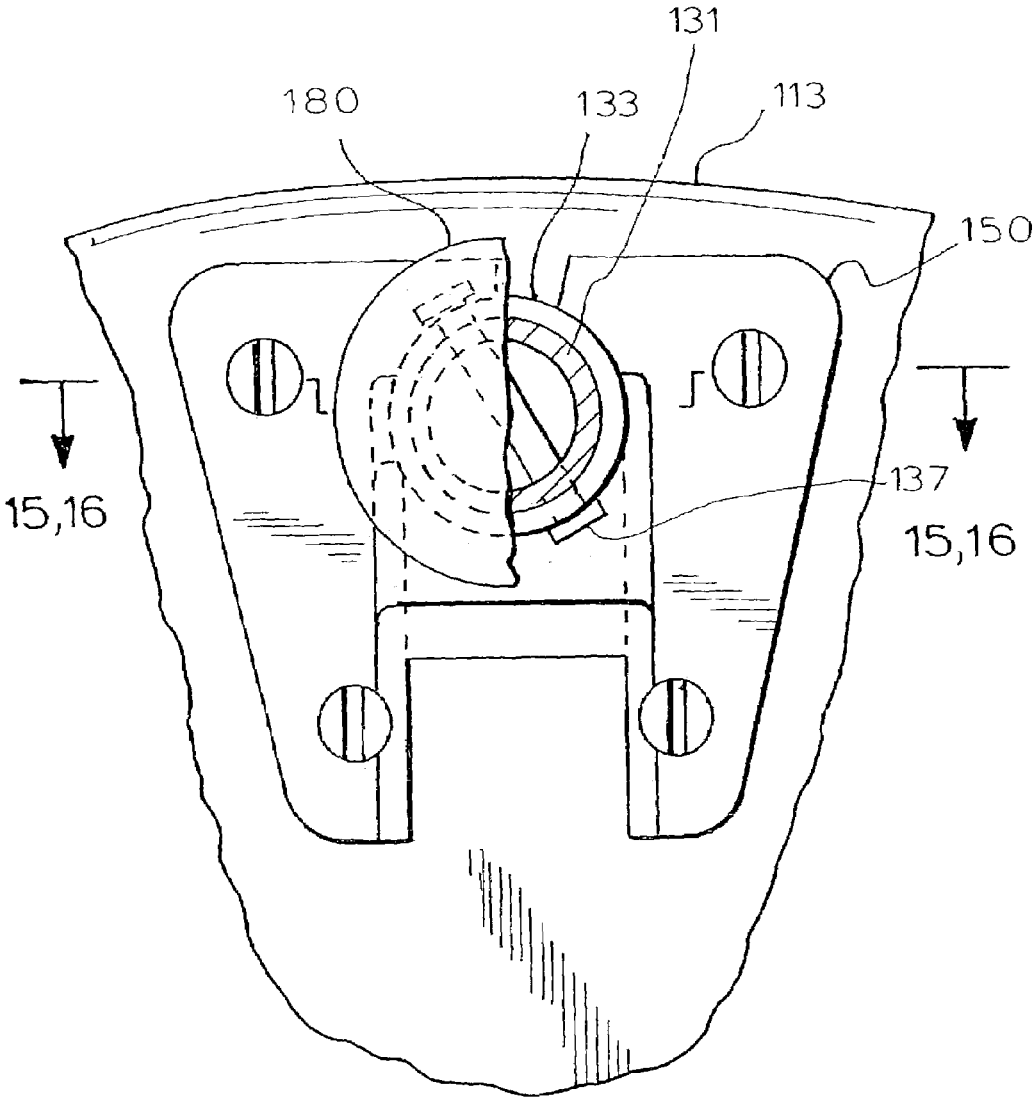
FIG. 14 is a close-up fragmentary view of an adjustable leg of the step exercise system of FIG. 8.

Referring to FIG. 10, preferably, the longitudinal axes of the inner and outer tubular members 131, 133 are aligned substantially perpendicular to the underside portion 122 of the main body 111 of the portable inclined aerobic step ramp 110. A contact surface 180 of the slip resistant tip 149 is aligned substantially parallel to the support surface S when the adjustable leg 126 is in either the retracted or extended positions. Thus, the contact surface 180 is aligned at an angle that is oblique to the longitudinal axis of the inner tubular member 131. Preferably, each contact surface 180 is substantially planar and comprises a substantial portion of a bottom surface of the associated adjustable leg 126. Also, preferably the contact surfaces 180 of each of the adjustable legs 126 are substantially co-planar with one another (and with the support surface S) when the adjustable legs 126 are simultaneously in either the retracted or extended position.

Preferably, the configuration of the inner and outer tubular members 131, 133 at each of the adjustable legs 126 are substantially identical, except for the length of the inner tubular members 131. It can be appreciated that the inner tubular portions 131 of adjustable legs 126 located closer to the front portion 112 of the main body 111 are shorter than those located further away.

Referring to FIG. 18, preferably, each adjustable leg 126 includes means to resist free movement of the inner tubular member 131 relative to the outer tubular member 133 while permitting a user to adjust the leg. Preferably, the inner tubular member 133 includes a through hole 184 through which a contact pin 186 of a resistance spring 188 protrudes. The resistance spring 188 is disposed within the inner tubular member 131. The contact pin 186 is biased against the outer tubular member 133 and the resulting friction creates a resistance to movement of the inner tubular member 131. The resistance spring 188 has a substantially V-shaped portion which contacts the inner tubular member 131 opposite the through hole 184.

Referring to FIGS. 2 and 19, the center and side workout areas 55, 56 preferably include non-slip panels 190, 194 formed of resilient material. The non-slip panels 190, 194 preferably have textured upper surfaces 196, 198. The lower surfaces 200, 202 of each non-slip surface 190, 194 preferably have elongated recessor channels 206 disposed at substantially regular intervals and aligned substantially parallel to the front portion 112 of the main body 111. It can be appreciated that material above the channels 206 is thinner than the material intermediate the channels 206. When subject to load, the resilient, non-slip panels deflect downwardly. The upper surface of the non-slip panels in the area above the channels 206 deflect a greater amount than the areas intermediate the channels 206. Under load, this provides substantial resistance to slippage. While not under load, the upper surface of each non-slip panel is substantially planar (except for any texture thereof). The substantially planar non-loaded configuration of the upper surface allows perspiration to drain unimpeded from the surface, prevents the undesirable build up of dirt on the surface and allows the surface to be cleaned more effectively.

Accordingly, a system for an aerobic step workout has been disclosed. While various embodiments of the invention have been shown and described, it should be apparent that many variations and alternative embodiments could be implemented in accordance with the teachings herein. It is understood, therefore, that the invention is not to be in any way limited except in accordance with the spirit of the appended claims and their equivalents.

What is claimed:

1. A step exercise system for an aerobic step workout, comprising:

a portable inclined step ramp having a main body portion, said main body portion having an upper workout surface portion;

a plurality of adjustable legs extending from said main body portion, each adjustable leg having a retracted supporting position and an extended supporting position;

each leg including means to lock said adjustable leg in one of said retracted or extended supporting positions;

each adjustable leg including a telescoping portion, a fixed portion and means to resist movement of said telescoping portion relative to said fixed portion, said resistance means being operable to allow a user to articulate said adjustable leg between said retracted and extended supporting positions, and being operable to substantially prevent articulation of said adjustable leg absent a force applied by said user;

said resistance means being independent of said means to lock said adjustable leg in said retracted and extended positions.

2. A step exercise system as in claim 1, wherein said resistance means comprises a means to create friction between said fixed portion and said telescoping portion.

3. A step exercise system as in claim 2, wherein said friction means comprises a projection extending from said telescoping portion, said projection being biased against and contacting said fixed portion of said adjustable leg.

4. A step exercise system for an aerobic step workout, comprising:

a portable inclined step ramp having a main body portion;

a plurality of adjustable legs extending from said main body portion, each adjustable leg having a retracted supporting position and an extended supporting position;

each adjustable leg having a fixed portion fixedly attached to said main body portion and having a telescoping portion which translates relative to said fixed portion;

said adjustable leg having a longitudinal axis aligned oblique to a support surface;

each adjustable leg having a contact surface aligned oblique to said longitudinal axis of said adjustable leg;

each contact surface being substantially planar and comprising a substantial portion of a bottom surface of said adjustable leg; and said contact surfaces of said adjustable legs being substantially parallel to said support surface when said adjustable legs are in either said retracted or extended supporting position.

5. A step exercise system, as in claim 4, wherein said contact surfaces of said adjustable legs are substantially co-planar when said adjustable legs are simultaneously in either said retracted or extended supporting position.

6. A step exercise system, as in claim 5, wherein said main body portion includes an underside portion and wherein said longitudinal axis of each adjustable leg is substantially perpendicular to said underside portion.

7. A step exercise system as in claim 4, wherein said telescoping portion rotates about said longitudinal axis of said adjustable leg relative to said fixed portion, and said telescoping portion is in a same rotational orientation relative to said fixed portion when said adjustable leg is in either said retracted or extended supporting position.

8. A step exercise system as in claim 4, wherein:

one of said fixed and telescoping portions of said adjustable leg has a slot;

an other of said fixed and telescoping portions has a projection disposed within and guided by said slot;

said slot has an angled portion aligned at an angle oblique to said longitudinal axis of said adjustable leg; and said projection being disposed adjacent a first closed end of said angled portion when said adjustable leg is one of said extended or retracted supporting positions.

9. A step exercise system for an aerobic step workout, comprising:

a portable inclined step ramp having a main body portion;

a plurality of adjustable legs extending from said main body portion, each adjustable leg having a retracted supporting position and an extended supporting position;

each adjustable leg having a fixed portion fixedly attached to said main body portion and having a telescoping portion which translates relative to said fixed portion;

said adjustable leg having a longitudinal axis aligned oblique to a support surface;

each adjustable leg having a contact surface aligned oblique to said longitudinal axis of said adjustable leg;

said contact surface of said adjustable legs being substantially parallel to said support surface when said adjustable legs are in either said retracted or extended supporting position;

said contacting surfaces of said adjustable legs being substantially co-planar when said adjustable legs are simultaneously in either said retracted or extended supporting position;

said main body portion including an underside portion and wherein said longitudinal axis of each adjustable leg is substantially perpendicular to said underside portion;

said telescoping portion rotating about said longitudinal axis of said adjustable leg relative to said fixed portion, and said telescoping portion is in a same rotational orientation relative to said fixed portion when said adjustable leg is in either said retracted or extended supporting position.

10. A step exercise system for an aerobic step workout, comprising:

a portable inclined step ramp having a main body portion;

a plurality of adjustable legs extending from said main body portion, each adjustable leg having a retracted supporting position and an extended supporting position;

each adjustable leg having a fixed portion fixedly attached to said main body portion and having a telescoping portion which translates relative to said fixed portion;

said adjustable leg having a longitudinal axis aligned oblique to a support surface;

each adjustable leg having a contact surface aligned oblique to said longitudinal axis of said adjustable leg;

said contact surfaces of said adjustable legs being substantially parallel to said support surface when said adjustable legs are in either said retracted or extended supporting position;

said contact surfaces of said adjustable legs being substantially co-planar when said adjustable legs are simultaneously in either said retracted or extended supporting position;

said telescoping portion rotating about said longitudinal axis of said adjustable leg relative to said fixed portion, and said telescoping portion is in a same rotational orientation relative to said fixed portion when said adjustable leg is in either said retracted or extended supporting position.

11. A step exercise system, as in claim 8, wherein said projection being disposed adjacent a second closed end when said adjustable leg is in an other of said retracted or extended supporting positions; and said first and second closed ends being aligned along a line substantially parallel to said longitudinal axis of said leg.

* * * * *